United States Patent [19]

Yasuoka et al.

[11] Patent Number: 4,649,877

[45] Date of Patent: Mar. 17, 1987

[54] METHOD OF CONTROLLING INTAKE AIR QUANTITY FOR INTERNAL COMBUSTION ENGINES AT IDLE

[75] Inventors: Akimasa Yasuoka, Nerima; Takeo Kiuchi, Nakano, both of Japan

[73] Assignee: Honda Giken Kogyo K.K., Tokyo, Japan

[21] Appl. No.: 838,376

[22] Filed: Mar. 11, 1986

[30] Foreign Application Priority Data

Mar. 13, 1985 [JP] Japan ..... 60-048408

[51] Int. Cl.[4] ..... F02M 3/00; F02M 3/07; F02M 23/04

[52] U.S. Cl. ..... 123/339; 123/585; 123/327; 123/480

[58] Field of Search ..... 123/339, 585, 327, 480

[56] References Cited

U.S. PATENT DOCUMENTS

| | | | |
|---|---|---|---|
| 4,508,074 | 4/1985 | Yamato et al. | 123/585 |
| 4,526,144 | 7/1985 | Hasegawa et al. | 123/339 |
| 4,539,967 | 9/1985 | Nakajima et al. | 123/339 |
| 4,553,516 | 11/1985 | Hasegawa | 123/585 |
| 4,570,592 | 2/1986 | Otoba | 123/339 |
| 4,572,141 | 2/1986 | Hasegawa et al. | 123/339 |
| 4,582,032 | 4/1986 | Hara et al. | 123/339 |

*Primary Examiner*—Raymond A. Nelli
*Attorney, Agent, or Firm*—Arthur L. Lessler

[57] ABSTRACT

An intake air quantity control method for an internal combustion engine at idle. A supplementary air quantity to be supplied to the engine through a first auxiliary air passage bypassing an engine throttle valve is controlled by a first control valve on the basis of a basic value of a control amount corresponding to the difference between actual engine speed and desired idling speed. A supplementary air quantity to be supplied to the engine through a second auxiliary air passage is controlled by a second control valve in response to engine temperature. A first correction value is calculated based upon detected atmospheric pressure encompassing the engine, and a second correction value based upon detected engine temperature and atmospheric pressure, respectively. The basic value of the control amount is corrected by means of the first and second correction values, and the first control valve is driven according to the corrected control amount basic value. Preferably, the second correction value is calculated from a value of the control amount corresponding to a supplementary air quantity estimated to be supplied through the second control valve at the detected engine temperature and from the first correction value based upon the detected atmospheric pressure.

4 Claims, 4 Drawing Figures

INTERNAL COMBUSTION ENGINE
FUEL INJECTION VALVES
INPUT CIRCUIT
CPU
MEMORY MEANS
OUTPUT CIRCUIT
ECU
Ne
TW
PBA
θth
PA
1
2
3
4
5
6
6a
6b
7
8
8a
8b
8c
9
9a
9b
9c
9d
10
10a
10b
10c
10d
10d'
10e
10f
11
12
13
14
15
16
17
18
19

METHOD OF CONTROLLING INTAKE AIR QUANTITY FOR INTERNAL COMBUSTION ENGINES AT IDLE

BACKGROUND OF THE INVENTION

This invention relates to a method of controlling intake air quantity for internal combustion engines at idle, and more particularly to a method of this kind which is capable of accurately controlling the intake air quantity when the engine is idling at a low atmospheric pressure, such as at a high altitude.

A conventional idling speed feedback control method for internal combustion engines has been known, which is adapted to electronically control a control valve for regulating the quantity of supplementary air to be supplied to the engine during idling through an air passage communicating at one end with an intake passage of the engine at a location downstream of a throttle valve therein and another end with the atmosphere, in a manner responsive to the difference between actual engine speed and desired idling speed set based, e.g. upon load on the engine.

Further, a conventional method of controlling intake air quantity for internal combustion engines has been known, wherein the engine is provided with a fast idling control device which is operated by mechanical actuator means to supply the engine with supplementary air in quantities responsive to the engine temperature through an air passage bypassing the throttle valve when the engine is in a cold state, so that the intake air quantity can be controlled to values suitable for improving the stability of idling of the engine in a cold state.

Furthermore, an intake air quantity control method for an internal combustion engine has been proposed, e.g. by Japanese Provisional Patent Publication (Kokai) No. 59-168238 assigned to the assignee of the present application published on Sept. 21, 1984, wherein the supplementary air quantity to be supplied to the engine is corrected by means of the aforementioned control valve by a correction value dependent upon atmospheric pressure encompassing the engine, so as to control the supplementary air quantity to an appropriate value corresponding to atmospheric pressure. According to this proposed method, the supplementary air quantity is corrected through the control valve in response to atmospheric pressure, by the use of a correction value dependent upon atmospheric pressure, thereby obtaining a supplementary air quantity corresponding to the difference between actual engine speed and desired idling speed and commensurate with atmospheric pressure. However, according to the proposed method, only the supplementary air quantity through the control valve can be corrected in response to atmospheric pressure, but the supplementary air quantity supplied through the fast idling control device is not corrected in response to atmospheric pressure. However, since the valve opening area of the fast idling control device is relatively large as compared with that of the throttle valve during idling, it is an essential requisite to compensate for a shortage and an excess of the supplementary air quantity through the fast idling control device due to a change in the atmospheric pressure so as to control the supplementary air quantity through the device to a value commensurate with atmospheric pressure.

SUMMARY OF THE INVENTION

It is the object of the invention to provide an intake air quantity control method for an internal combustion engine provided with a fast idling control device, which is applicable during idling of the engine and capable of accurately correcting intake air quantity being supplied to the engine in response to atmospheric pressure encompassing the engine when it is idling at a low atmospheric pressure such as at a high altitude, to thereby supply with accuracy a required quantity of intake air to the engine at idle.

The present invention provides a method of controlling the quantity of intake air being supplied to an internal combustion engine during idling thereof, the engine having an intake passage, a throttle valve arranged in the intake passage, a first auxiliary air passage bypassing the throttle valve, a first control valve arranged in the first auxiliary air passage for controlling the quantity of supplementary air to be supplied to the engine through the first auxiliary air passage on the basis of a basic value of a control amount corresponding to the difference between actual engine speed and desired idling speed, a second auxiliary air passage bypassing the throttle valve, and a second control valve arranged in the second auxiliary air passage for controlling the quantity of supplementary air to be supplied to the engine through the second auxiliary air passage in response to a temperature of the engine.

The method according to the present invention is characterized by comprising the follwing steps: (a) detecting atmospheric pressure encompassing the engine; (b) calculating a first correction value based upon the atmospheric pressure thus detected; (c) detecting the temperature of the engine; (d) calculating a second correction value based upon the detected engine temperature and atmospheric pressure; (e) correcting the basic value of the control amount by means of the first and second correction values thus calculated; and (f) driving the first control valve according to the basic value of the control amount thus corrected.

Preferably, the step (d) comprises the steps of: calculating a value of the control amount for the first control valve corresponding to a supplementary air quantity which is estimated to be supplied to the engine through the second control valve, at the detected engine temperature; and calculating the second correction value from the value of the control amount thus calculated and the calculated first correction value based upon the detected atmospheric pressure.

Preferably, the step (e) comprises the steps of: multiplying the basic value of the control amount by the first correction value; and thereafter adding the second correction value to the resulting product of the basic value of the control amount and the first correction value thus obtained.

Preferably, the engine has electronic control means, the control amount being the value of electric current of a driving signal supplied from the electronic control means to said first control valve.

The above and other objects, features and advantages of the invention will be more apparent from the ensuing detailed description taken in conjunction with the accompanying drawings.

DETAILED DESCRIPTION

The method of the invention will be described in detail with reference to the accompanying drawings.

Figure 1:
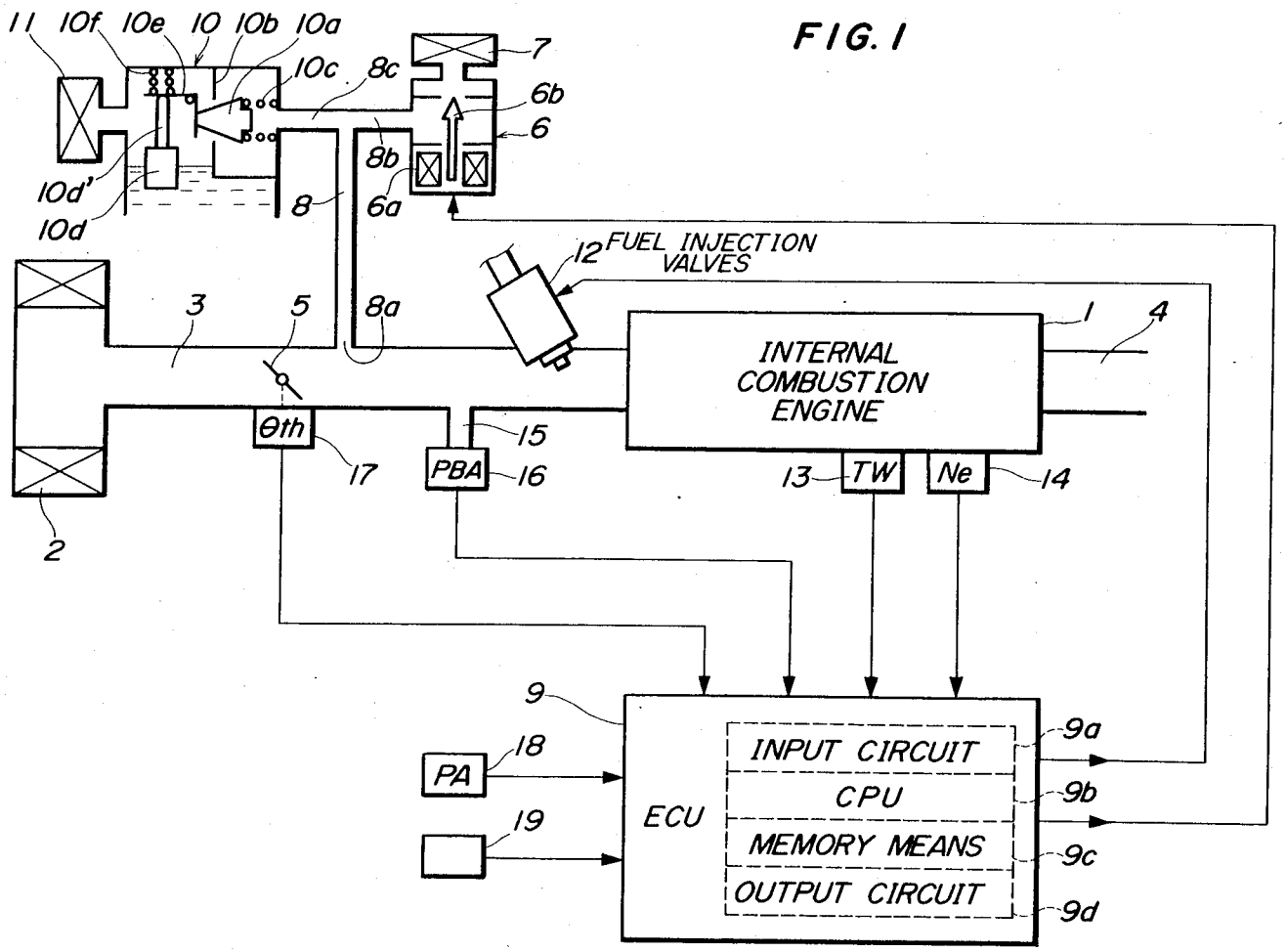
FIG. 1 is a view illustrating an embodiment of the whole arrangement of an intake air quantity control system for an internal combustion engine, to which is applied the method of the invention.

Referring first to FIG. 1, an intake air quantity control system for an internal combustion engine during idling is schematically illustrated, to which is applied an embodiment of the method of the invention. In FIG. 1, reference numeral 1 designates an internal combustion engine which may be a four-cylinder type, and to which are connected an intake pipe 3 with an air cleaner 2 mounted at its open end and an exhaust pipe 4, at an intake side and at an exhaust side of the engine 1, respectively. A throttle valve 5 is arranged within the intake pipe 3, and an air passage 8 opens at its open end 8*a* into the intake pipe 3 at a location downstream of the throttle valve 5. A first auxiliary air passage 8*b* branches off from the air passage 8 at a location upstream of the open end 8*a*, and communicates with the atmosphere at its end mounted with an air cleaner 7. Arranged across the first auxiliary air passage 8*b* is a first supplementary air quantity control valve (hereinafter merely called "the first control valve" unless otherwise specified) 6 which controls the quantity of supplementary air being supplied to the engine 1 through the first auxiliary air passage 8*b*. This first control valve 6 is a so-called linear solenoid type of which the valve opening varies in proportion to the value of electric current of a driving signal applied thereto, and comprises a solenoid 6*a* electrically connected to an electronic control unit (hereinafter called "the ECU") 9 to be supplied with a driving signal from the ECU 9, and a valve body 6*b* disposed to open the first auxiliary air passage 8*b* upon energization of the solenoid 6*a* by a valve opening (valve lift) corresponding to the electric current value of the driving signal from the ECU 9.

A second auxiliary air passage 8*c* branches off from the air passage 8 at a location upstream of the open end 8*a*, of which the atmosphere-opening end is provided with an air cleaner 11. A fast idling control device 10 as a second supplementary air quantity control valve is arranged across the second auxiliary air passage 8*c*. The fast idling control device 10 comprises, for instance, a valve body 10*a* disposed to be urged against its valve seat 10*b* by a spring 10*c* for closing the second auxiliary air passage 8*c*, a sensor means 10*d* adapted to stretch or contract its arm 10*d*' in response to the engine cooling water temperature, and a lever 10*e* pivotable in response to the stretching and contracting action of the arm 10*d*' of the sensor means 10*d* for displacing the valve body 10*a* so as to open or close the air passage 8*c*.

Fuel injection valves 12 are arranged in a manner projected into the interior of the intake pipe 3 at a location between the engine 1 and the open end 8*a* of the air passage 8 opening into the intake pipe 3. An intake pipe absolute pressure (PBA) sensor 16 is provided in communication through a conduit 15 with the intake pipe 3 at a location between the engine 1 and the open end 8*a*. The fuel injection valves 12 are connected to a fuel pump, not shown, and also electrically connected to the ECU 9, while the intake pipe absolute pressure (PBA) sensor 16 is electrically connected to the ECU 9. A throttle valve opening ($\theta$TH) sensor 17 is connected to the throttle valve 5 for detecting its valve opening, while an engine temperature (TW) sensor 13 for detecting the engine cooling water temperature TW as representing the engine temperature is mounted on the main body of the engine 1.

An engine rotational speed (Ne) sensor 14 is arranged on a camshaft, not shown, of the engine 1 or a crankshaft of same, not shown, and adapted to generate one pulse at a particular crank angle position of each of the engine cylinders, which is in advance of the top-dead-center position (TDC) of a piston in the cylinder immediately before its suction stroke, by a predetermined crank angle, each time the engine crankshaft rotates through 180 degrees, i.e., each pulse of the top-dead-center position (TDC) signal. Pulses of the TDC signal generated by the Ne sensor 14 are supplied to the ECU 9.

An atmospheric pressure (PA) sensor 18 for detecting the atmospheric pressure encompassing the engine 1 and other sensors 19 such as a sensor for detecting the intake air temperature are all connected to the ECU 9.

The ECU 9 comprises an input circuit 9*a* having functions of shaping waveforms of pulses of input signals from the aforementioned sensors, shifting voltage levels of the input signals, and converting analog values of the input signals into digital signals, etc., a central processing unit (hereinafter called "the CPU) 9*b*, memory means 9*c* for storing various calculation programs such as a KPAD-PA table and a IMTW-TW table, both hereinafter referred to, executed within the CPU 9*b* as well as various calculated data from the CPU 9*b*, and an output circuit 9*d* for supplying driving signals to the fuel injection valves 12 and the control valve 6.

The intake air quantity control system constructed as above operates as follows:

The fast idling control device 10 operates when the engine cooling water temperature is lower than a predetermined value (e.g. 40° C.), such as at the start of the engine in a cold state. More specifically, the sensor means 10*d* stretches or contracts its arm 10*d*' in response to the engine cooling water temperature. This sensor means 10*d* may comprise any suitable sensing means, such as wax filled within a casing, which is thermally expandable. When the engine cooling water temperature is lower than the predetermined value, the arm 10*d*' is in a contracted state, with the lever 10*e* biased by the force of a spring 10*f* in such a position as to displace the valve body 10*a* in a rightward direction as viewed in FIG. 1 against the force of the spring 10*c* whereby the second auxiliary air passage 8*c* opens. Since the air passage 8*c* thus opened allows the supply of a sufficient amount of supplementary air to the engine 1 through the filter 11, the device 10, and the air passages 8*c*, 8, when the engine temperature is lower than the predetermined value, the engine speed can be maintained at a higher value than a normal idling speed, thereby ensuring smooth and stable idling operation of the engine even in a cold state without the fear of engine stall.

As the arm 10*d*' of the sensor means 10*d* is stretched with an increase in the engine cooling water temperature due to the warming-up of the engine, it pushes the lever 10*e* upward as viewed in FIG. 1 to rotate same in the clockwise direction. Then, the valve body 10*a* becomes moved leftward as viewed in FIG. 1, rather by the force of the spring 10*c*. When the engine cooling water temperature exceeds the predetermined value, the valve body 10*a* comes into urging contact with the valve seat 10*b* to close the second auxiliary air passage 8*c*, thereby interrupting the supply of supplementary air through the fast idling control device 10. Thus, when the engine temperature is lower than the predetermined value, the valve opening of the valve body 10*a* of the fast idling device 10 varies in response to the engine temperature, so as to supply the engine with supplementary air in a quantity corresponding to the engine temperature.

The fast idling control device 10 may be comprised of another fast idling control device operable to increase intake air quantity being supplied to the engine by an amount sufficient for maintaining the engine speed during idling of the engine at a value higher than a normal idling speed when the engine temperature is lower than a predetermined value, such as one disposed to forcibly open the throttle valve by a predetermined valve opening.

On the other hand, control amount for the control valve 6 is calculated by the ECU 9 as a command value, and the control valve 6 is driven by a driving signal from the ECU 9 corresponding to the calculated command value of the control amount. More specifically, the solenoid 6*a* of the control valve 6 is supplied with a driving signal having an electric current value which corresponds to a command value ICMD, hereinafter described, indicative of the desired magnitude of electric current of the driving signal and calculated by the ECU 9, whereby the valve body 6*b* opens the second auxiliary air passage 8*b* by a valve opening corresponding to the electric current value of the driving signal from the ECU 9.

Figure 2:
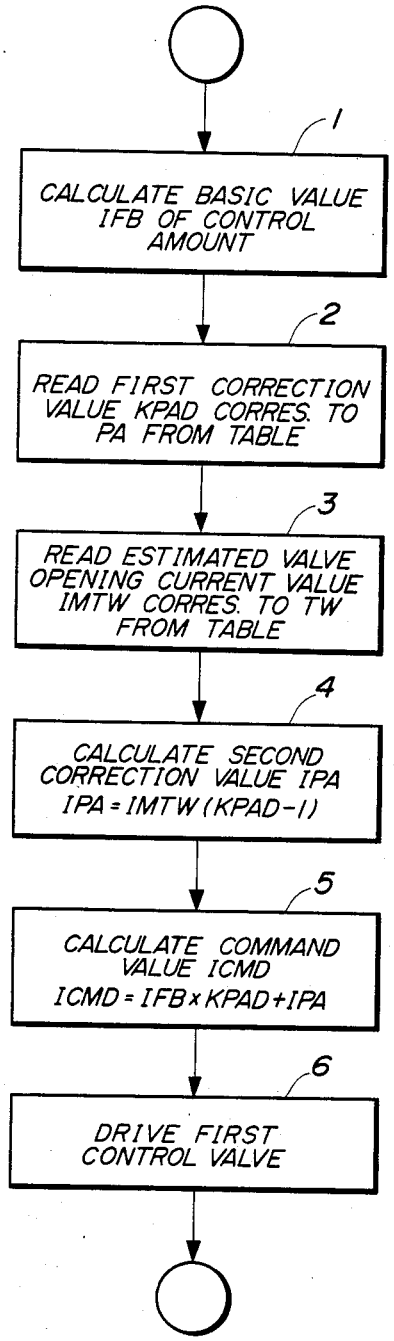
FIG. 2 is a flow chart showing a manner of controlling a first supplementary air quantity control valve appearing in FIG. 1, according to an embodiment of the present invention.

Next, a manner of controlling the control valve 6, i.e. a manner of controlling the intake air quantity, according to an embodiment of the invention will be explained with reference to FIG. 2 showing a control program to be executed in synchronism with generation of TDC signal pulses within the CPU 9*b*.

First, at step 1, a basic value IFB of a control amount of the first supplementary air quantity control valve 6 is calculated in a known manner responsive to the difference between the desired idling speed and the actual rotational speed Ne detected by the Ne sensor 14. The basic value IFB of the control amount of the control valve 6 is expressed in terms of the magnitude of electric current of a driving signal supplied from the ECU 9 to the control valve 6.

Figure 3:
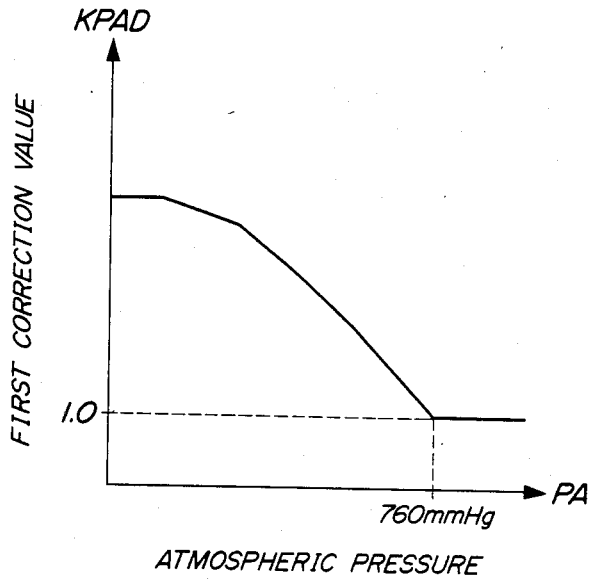
FIG. 3 is a graph of a table showing an example of the relationship between a first correction value KPAD an atmospheric pressure PA.

Then, at step 2, a first correction value KPAD is calculated. More specifically, the first correction value KPAD is read from the KPAD-PA table stored in the memory means 9*c*, which corresponds to the atmospheric pressure PA detected by the atmospheric pressure sensor 18. FIG. 3 shows the KPAD-PA table with an example of the relationship between the atmospheric pressure PA and the first correction value KPAD. As shown in FIG. 3, while the first correction value KPAD is held at a value 1.0 when the atmospheric pressure PA is equal to or higher than 760 mmHg, it is set to larger values as the atmospheric pressure PA decreases from 760 mmHg. At the step 2, the first correction value KPAD is set to a value corresponding to the detected atmospheric pressure PA, so as to make the product (IFB×KPAD) of the basic value IFB of the control amount of the control valve 6 and the first correction value KPAD, i.e. the electric current value of the driving signal for the contorl valve 6 optimal commensurate with the detected atmospheric pressure PA. The product (IFB×KPAD) is calculated at step 5, hereinafter described.

Figure 4:
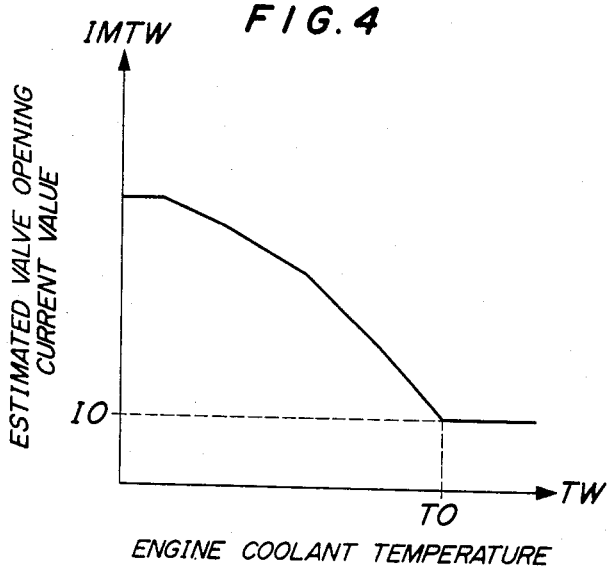
FIG. 4 is a graph of a table showing an example of the relationship between an estimated valve opening current value IMTW for calculation of a second correction value IPA and the engine coolant temperature TW.

Next, at step 3, the CPU 9*b* calculates an electric current value IMTW which should be supplied to the control valve 6 on the presumption that the control valve 6 is to supply a supplementary air quantity which the fast idling control device 10 is estimated to actually supply to the engine 1 through its valve body 10*a* at detected engine temperature, on the basis of the engine coolant temperature TW detected by the TW sensor 13. The electric current value IMTW is hereinafter called "the estimated valve opening current value" unless otherwise specified. More specifically, the estimated valve opening current value IMTW is read from the IMTW-TW table stored in the memory means 9*c*. FIG. 4 shows the IMTW-TW table with an example of the relationship between the estimated valve opening current value IMTW and the engine coolant temperature TW. As shown in FIG. 4, while the current value IMTW is held at a predetermined value I0 when the engine coolant temperature TW is equal to or higher than a predetermined value T0 (e.g. 40° C.), it is set to larger values as the engine coolant temperature TW decreases from the predetermined value T0. The IMTW-TW table is set in accordance with actual operating characteristics of the fast idling control device 10 and the control valve 6.

Then, step 4 is executed to calculate a second correction value IPA from the first correction value KPAD corresponding to the detected atmospheric pressure and the estimated valve opening current value IMTW corresponding to the detected engine temperature, which have been obtained at the steps 2 and 3, respectively, by the use of the following equation (1):

$$IPA = IMTW \times (KPAD - 1) \quad (1)$$

As is learned from the equation (1), the second correction value IPA represents a difference value obtained by subtracting the estimated valve opening current value IMTW corresponding to the supplementary air quantity which the fast idling control device 10 is estimated to actually supply to the engine 1 from a value (IMTW×KPAD) corresponding to a supplementary air quntity which the fast idling control device 10 should supply to the engine 1.

Then, at the step 5, the command value ICMD of the control amount of the control valve 6 is calculated by correcting the basic value IFB of the control amount of the control valve 6 obtained at the step 1 by means of the first and second correciton values KPAD and IPA obtained at the steps 2 and 4, respectively, by the use of the following equation (2):

$$ICMD = IFB \times KPAD + IPA \quad (2)$$

As is learned from the equation (2), the command value ICMD is the sum of the product (IFB×KPAD) and the second correction value IPA.

At step 6, the output circuit 9*d* outputs a driving signal having an electric current value corresponding to the command value ICMD obtained at the step 5, to drive the control valve 6 according to the calculated command value ICMD.

Incidentally, although in the foregoing embodiment, the control valve 6 is a linear solenoid type of which the valve opening is proportionate to the electric current value of a driving signal applied thereto, this is not limitative, but a control valve of an on-off solenoid type may be employed, of which the valve opening duty ratio is on-off controlled by a command value of the duty ratio of a driving pulse signal from the ECU 9 as the control amount and calculated in a manner similar to one shown in FIG. 2.

As described above, according to the method of the invention, the first correction value KPAD is calculated based on detected atmospheric pressure PA, the second correction value IPA is calculated from detected engine temperature TW and the calculated first correction value KPAD, the basic value IFB of the control amount of the first control valve 6 calculated in response to the difference between the actual engine speed Ne and the desired idling speed is corrected by means of the first and second correction values KPAD and IPA, and the first control valve 6 is driven according to the thus corrected basic value (IFB×KPA+IPA). Therefore, a required quantity of intake air can be accurately supplied to the engine when it is idling at a low atmospheric pressure, such as at a high altitude, thereby enabling accurate control of the engine speed during idling operation of the engine.

More specifically, since the control valve 6 and the fast idling control device 10 are controlled in response to engine operating parameters different from each other, i.e. the difference between actual engine speed Ne and desired idling speed, and the engine temperature TW, respectively, compensation for a shortage and an excess of the supplementary air quantity through the fast idling control device 10 due to a change in the atmospheric pressure cannot be made to a satisfactory degree, for instance, by adjusting the supplementary air quantity through the control valve 6 through multiplying same by the sum of values of an atmospheric pressure-dependent correction coefficient for the control valve 6 and a similar atmospheric pressure-dependent correction coefficient for the fast idling control device 10, which can result in an inaccurate correction of the intake air quantity in response to atmospheric pressure during idling of the engine at a low atmospheric pressure. According to the method of the invention, since the basic value IFB of the control amount of the control valve 6 is multiplied by the first correction value KPAD based upon the detected atmospheric pressure PA, and added to the resulting product (IFB×KPAD) is the second correction value IPA (=IMTW×(KPAD−1)) for the fast idling control device 10, the intake air quantity can be accurately corrected in response to atmospheric pressure during idling of the engine at a low atmospheric pressure, so that the engine is supplied with an appropriate quantity of intake air.

What is claimed is:

1. A method of controlling the quantity of intake air being supplied to an internal combustion engine during idling thereof, said engine having an intake passage, a throttle valve arranged in said intake passage, a first auxiliary air passage bypassing said throttle valve, a first control valve arranged in said first auxiliary air passage for controlling the quantity of supplementary air to be supplied to said engine through said first auxiliary air passage on the basis of a basic value of a control amount corresponding to the difference between actual engine speed and desired idling speed, a second auxiliary air passage bypassing said throttle valve, and a second control valve arranged in said second auxiliary air passage for controlling the quantity of supplementary air to be supplied to said engine through said second auxiliary air passage in response to a temperature of said engine, the method comprising the steps of: (a) detecting atmospheric pressure encompassing said engine; (b) calculating a first correction value based upon the atmospheric pressure thus detected; (c) detecting the temperature of said engine; (d) calculating a second correction value based upon the detected engine temperature and atmospheric pressure; (e) correcting said basic value of said control amount by means of said first and second correction values thus calculated; and (f) driving said first control valve according to said basic value of said control amount thus corrected.

2. A method as claimed in claim 1, wherein said step (d) comprises the steps of: calculating a value of said control amount for said first control valve corresponding to a supplementary air quantity which is estimated to be supplied to said engine through said second control valve, at the detected engine temperature; and calculating said second correction value from said value of said control amount thus calculated and said calculated first correction value based upon said detected atmospheric pressure.

3. A method as claimed in claim 1, wherein said step (e) comprises the steps of: multiplying said basic value of said control amount by said first correction value; and thereafter adding said second correction value to the resulting product of said basic value of said control amount and said first correction value thus obtained.

4. A method as claimed in any one of claims 1 to 3, wherein said engine has electronic control means, said control amount being the value of electric current of a driving signal supplied from said electronic control means to said first control valve.

* * * * *